US006886513B2

(12) United States Patent
Hammer

(10) Patent No.: US 6,886,513 B2
(45) Date of Patent: May 3, 2005

(54) VALVE MECHANISM COMPRISING A VARIABLE CROSS-SECTION OF A VALVE OPENING

(75) Inventor: Uwe Hammer, Hemmingen (DE)

(73) Assignee: Robert Bosch GbmH, Stuttgart (DE)

( * ) Notice: Subject to any disclaimer, the term of this patent is extended or adjusted under 35 U.S.C. 154(b) by 0 days.

(21) Appl. No.: 10/399,658

(22) PCT Filed: May 3, 2002

(86) PCT No.: PCT/DE02/01602

§ 371 (c)(1),
(2), (4) Date: Oct. 6, 2003

(87) PCT Pub. No.: WO03/018967

PCT Pub. Date: Mar. 6, 2003

(65) Prior Publication Data

US 2004/0050354 A1 Mar. 18, 2004

(30) Foreign Application Priority Data

Aug. 21, 2001 (DE) ..... 101 40 941

(51) Int. Cl.[7] ..... F01L 3/10
(52) U.S. Cl. ..... 123/90.67; 123/90.16
(58) Field of Search ..... 123/70.67, 90.16, 123/90.48

(56) References Cited

U.S. PATENT DOCUMENTS

| | | | | |
|---|---|---|---|---|
| 3,881,459 A | | 5/1975 | Gaetcke | |
| 4,901,683 A | | 2/1990 | Huff | |
| 5,381,765 A | * | 1/1995 | Rhodes | 123/90.67 |

FOREIGN PATENT DOCUMENTS

| | | |
|---|---|---|
| DE | 26 36 519 A1 | 8/1976 |
| JP | 57-200609 | 12/1982 |
| JP | 58-35211 | 3/1983 |
| JP | 08-189319 | 7/1996 |

* cited by examiner

*Primary Examiner*—Thomas Denion
*Assistant Examiner*—Zelalem Eshete
(74) *Attorney, Agent, or Firm*—Ronald E. Greigg

(57) ABSTRACT

The invention relates to an intake or exhaust valve mechanism with a variable valve opening cross section for use in an admission opening of an internal combustion engine and having a gas exchange valve acted on by the force of a valve spring and displaceable axially back and forth inside a guide by a valve control unit; the position of the sealing slide relative to the gas exchange valve in the axial direction is continuously variable by means of an adjusting unit. A sealing slide is disposed coaxially to the gas exchange valve, is acted upon by the force of a coupling spring, and is displaceable axially back and forth by the valve control unit.

19 Claims, 2 Drawing Sheets

VALVE MECHANISM COMPRISING A VARIABLE CROSS-SECTION OF A VALVE OPENING

CROSS-REFERENCE TO RELATED APPLICATIONS

This application is a 35 USC 371 application of PCT/DE 02/01602 filed on May 3, 2002.

BACKGROUND OF THE INVENTION

1. Field of the Invention

The invention relates to a valve mechanism with a variable valve opening cross section and particularly to such a valve for use as an intake or an exhaust valve of an internal combustion engine.

2. Prior Art

In internal combustion engines used as driving engine for motor vehicles a fuel-air mixture is compressed and ignited in the work chamber. The energy produced is converted into mechanical work. It is known for air or the fuel-air mixture to be delivered to the work chamber via valves (intake or inlet valves), and for the products of combustion to be removed from the work chamber via valves (exhaust or outlet valves). For determining the efficiency of the engine, controlling these valves is of great significance. In particular, the gas exchange in the work chamber is controlled by way of controlling the valves.

In addition to camshaft control, it is also known to employ an electrohydraulic valve control. Electrohydraulic valve control offers the capability of variable or fully variable valve control, making it possible to optimize the gas exchange and thus to enhance the efficiency of the engine.

The electrohydraulic valve control includes a hydraulically actuatable control valve, whose control valve piston actuates a valve body of the inlet and outlet valves and leads to a valve seat (valve seat ring) (closure of the valve) or moves away from it (opening of the valve). The control valve can be actuated via a pressure control of a hydraulic medium. The pressure control is effected here via magnet valves incorporated into the hydraulic circuit. To achieve the most optimal possible gas exchanges, the highest possible switching speeds of the control valve are needed. As a result of these high switching speeds, the valve body of the inlet and outlet valves strikes the valve seat ring at high speed. The result is on the one hand noise, and on the other, the partners in the valve suffer relatively high wear.

European Patent Disclosure EP 0 455 761 B1, for instance, has a hydraulic valve control device for an internal combustion engine as its subject. The fundamental technological principle of this embodiment is to displace a motor valve by means of a controlled pressure of a hydraulic fluid. In this embodiment, it is provided that an electronic control unit triggers a magnet valve, which in turn controls the motion of a storage piston, by way of which the stroke of the motor valve is varied.

European Patent Disclosure EP 0 512 698 A1 describes an adjustable valve system for an internal combustion engine. This embodiment is one example of mechanical valve control via cams of a rotating camshaft.

U.S. Pat. No. 4,777,915 has an electromagnetic valve control system for an internal combustion engine as its subject. A similar embodiment of an electromagnetic valve control is known from EP 0 471 614 A1. In these embodiments, the valve is moved back and forth to different positions by electromagnetic force. The electromagnets are disposed inside a housing part of the cylinder head, in two different regions. By the alternating activation of the electromagnets, the valve is moved alternatingly into two terminal positions, corresponding to the opening and closing positions of the valve, respectively. In these terminal positions of the valve, the admission opening for the fuel-air mixture into the combustion chamber is then opened to the widest extent or completely closed.

Another embodiment is known from EP 0 551 271 B1. This embodiment involves a valve mechanism with a plate valve, which is disposed in a passage of an internal combustion engine. The fundamental principle of this embodiment is that the valve plate is divided into two parts; one half of the valve plate executes only a fraction of the stroke executed by the other half of the valve plate.

In these known embodiments for valve control, the major effort of production and assembly of the valve mechanism, because of its complicated design, is especially disadvantageous. This adversely affects the costs for production and assembly. Moreover, in these embodiments, extremely high speeds and strong forces for valve control are necessary, so that an increased vulnerability to malfunction of the valve control from major wear of the parts of the valve mechanism is unavoidable.

SUMMARY OF THE INVENTION

The valve mechanism of the invention offers the advantage over the prior art of creating a variable valve opening cross section by simple means. Because a sealing slide disposed coaxially to the gas exchange valve is acted upon by the force of a coupling spring, and is displaceable axially back and forth by the valve control unit, and preferably the position of the sealing slide relative to the gas exchange valve is continuously variable in the axial direction by a valve control unit, a valve mechanism is created which has a simple design and which functions reliably and durably. The advantage of the valve mechanism of the invention is in particular that a variable valve opening cross section can be created, and each individual valve can be regulated separately. With the valve mechanism of the invention, the variable valve opening cross section can advantageously be created without high speeds and without strong forces, so that the vulnerability of this valve mechanism to malfunction is very slight. The valve mechanism of the invention can be produced and assembled economically, because of its simple design. The invention advantageously creates a variable valve control by which optimization of the gas exchange and thus an increase in motor efficiency of the engine is possible.

In a preferred feature of the invention, it is provided that the valve control unit is a camshaft.

In a further preferred feature of the invention, it is provided that the gas exchange valve has a rotationally symmetrical basic construction and comprises a valve shaft, on whose lower end a valve plate is disposed.

In a further preferred feature of the invention, it is provided that the valve plate has a conical circumferential face, which forms the sealing seat of the gas exchange valve.

Also in a preferred feature of the invention, it is provided that in the closing position of the valve mechanism, the sealing seat of the gas exchange valve directly contacts both a sealing seat of the sealing slide and a valve seat ring of the cylinder head.

Moreover, in a preferred feature of the invention, it is provided that the sealing slide comprises a bushlike bearing body, which is disposed displaceably axially back and forth inside a guide of the cylinder head.

As a result of these advantageous features of the invention, the delivery of the fuel-air mixture can be regulated with great precision, and a high efficiency of the engine can thus be achieved.

BRIEF DESCRIPTION OF THE DRAWINGS

Further advantageous features of the invention will become apparent from the detailed description contained herein below, taken in conjunction with the drawings, in which.

DESCRIPTION OF THE PREFERRED EMBODIMENT

Figure 1:
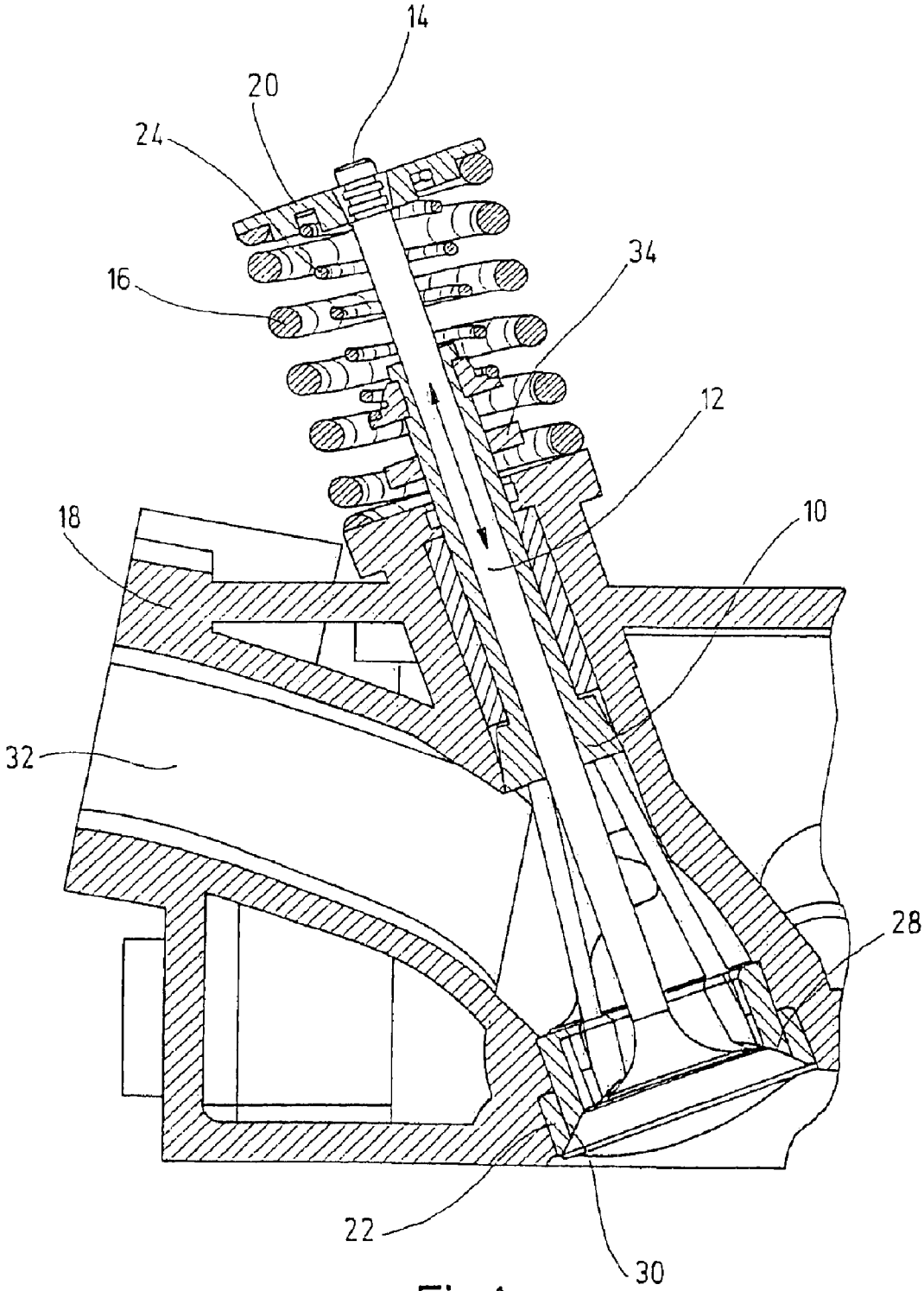
FIG. 1 is a section through a cylinder head with the valve mechanism of the invention.

In both figures, the individual parts of the valve mechanism of the invention are shown schematically and only with those components essential to the invention. Identical parts of the valve mechanism of the invention are identified by the same reference numerals throughout the drawings and as a rule will each be described only once.

In FIG. 1, the valve mechanism of the invention is shown in its disposition in the cylinder head 18 of an internal combustion engine. The valve mechanism has a gas exchange valve 12, which is acted upon by the force of a valve spring 16. The gas exchange valve 12 is displaceable axially back and forth inside a guide, and the displacement motion is generated by a valve control unit. In a preferred feature of the invention, a camshaft (not shown) is provided as the valve control unit.

The gas exchange valve 12 has a rotationally symmetrical basic construction and comprises a valve shaft 14, on the lower end of which a valve plate 20 is disposed. FIG. 1 shows the valve mechanism in the closing position of the gas exchange valve 12. The sealing seat 28 of the gas exchange valve 12 is in direct contact with both a sealing seat 30 of the sealing slide 10 and a valve seat ring 22 of the cylinder head 18.

The structure and mode of operation of gas exchange valves 12 per se are well known, so that this need not be addressed in further detail in the context of the present description.

The invention provides that a sealing slide 10 is disposed coaxially to the gas exchange valve 12. The sealing slide 10 is acted upon by the force of a coupling spring 24 and is displaceable axially back and forth. The displacement motion of the sealing slide 10 is likewise generated by the camshaft (not shown), by which the displacement motion of the gas exchange valve 12 is controlled.

Figure 2:
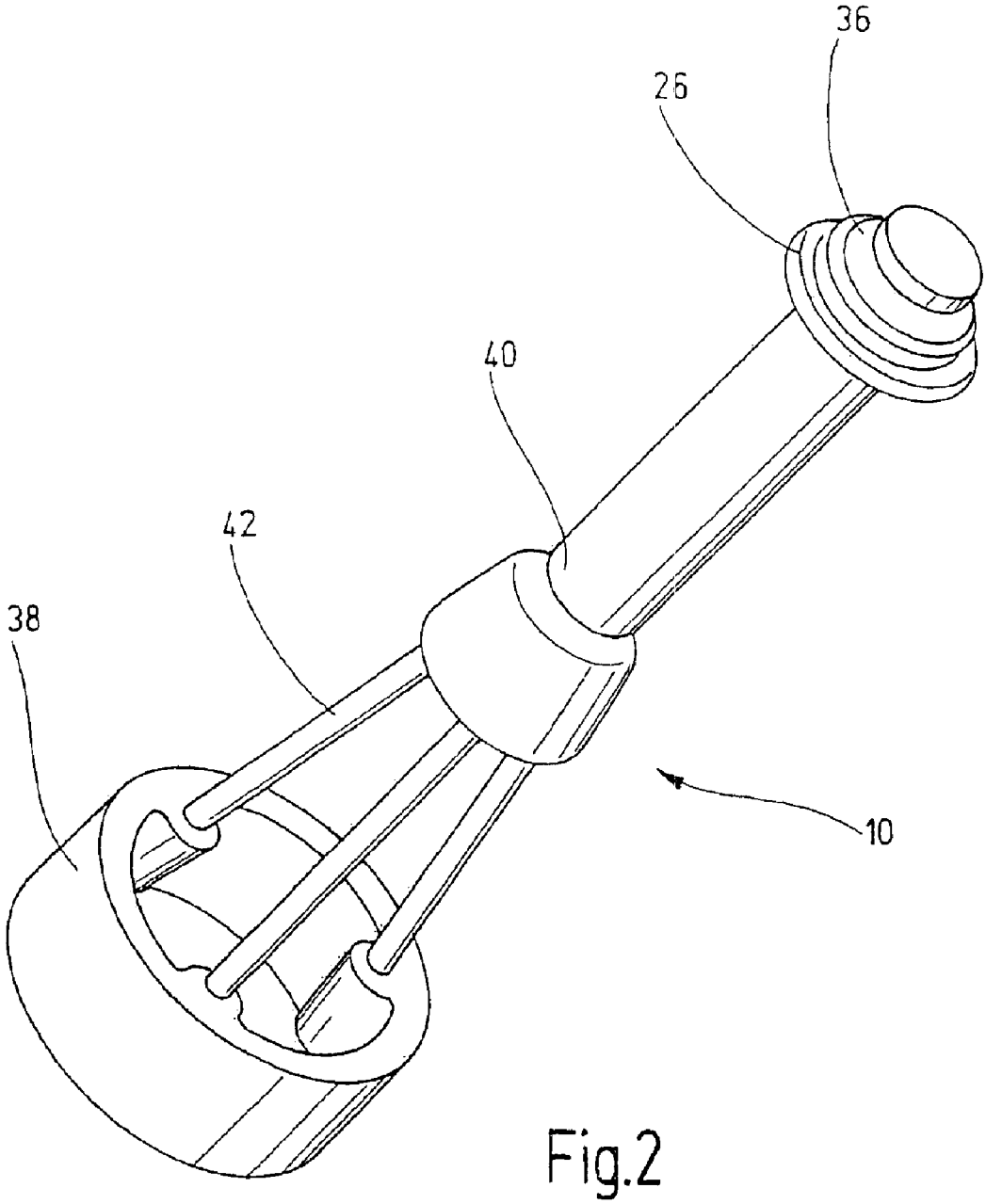
FIG. 2 is a perspective view of a sealing slide of the valve mechanism of the invention.

In FIG. 2, the sealing slide 10 is shown schematically in a perspective view. The sealing slide 10 substantially comprises a bearing body 40 and a sealing body 38. The bearing body 40 of the sealing slide 10 is embodied in bushlike fashion and is disposed displaceably axially back and forth inside a guide of the cylinder head 18. On its lower end, the sealing slide 10 has a cylindrical sealing body 38, whose outer face forms the sealing seat 30. The sealing body 38 is connected to the bearing body 40 via connecting rods 42.

A stop disk 26 is secured to the bearing body 40, near the upper end thereof. To facilitate assembly, this stop disk 26 comprises two parts. The two parts of the stop disk 26 are surrounded by a clamping ring 36, by which they are held together.

The connection between the sealing body 38 and the bearing body 40 is designed such that sufficient room remains for the air flowing through, or for the fuel-air mixture. As a result, for letting the air or the fuel-air mixture both in and out, there is advantageously a large enough admission opening inside the sealing slide 10 to allow this medium to flow through unhindered.

The valve mechanism shown in FIGS. 1 and 2 has the following function:

By means of the valve control unit, which in a preferred feature of the invention is a camshaft (not shown), the gas exchange valve 12 can either be opened or closed. The gas exchange valve 12 is pressed downward on the valve shaft 14 via the camshaft, as in a conventional valve drive, the course of motion of the gas exchange valve 12 is thus controlled. All known methods that are based on the known principle of the cup tappet, tilt lever, drag lever, and the like, can be employed.

The camshaft operates counter to the restoring force of the valve spring 16 that is braced on the cylinder head 18 and on the valve plate 20 which moves jointly with the gas exchange valve 12. By rotation of the camshaft, the gas exchange valve 12 is pressed downward, and the sealing seat 28 of the gas exchange valve 12 lifts away from the valve seat ring 22.

Via the coupling spring 24, which is under a certain initial tension, the sealing slide 10 is moved in slaved fashion with valve 12. The coupling spring 24 is braced on the valve plate 20 and on the stop disk 26, which is connected to the sealing slide 10. As a result, the sealing seat 30 of the sealing slide 10 is pressed against the sealing seat 28 of the gas exchange valve 12. Since an annular gap seal exists between the sealing body 38 and the valve seat ring 22, only a very slight air quantity (leakage) can reach the combustion chamber from the manifold 32.

The gas exchange valve 12 and thus also the sealing slide 10 follow the cam course, until the stop disk 26 strikes the control slide 34.

The control slide 34 is adjustable in the axial direction of the valve shaft 14 in its outset position relative to the gas exchange valve 12. The adjustment can be done electrically, hydraulically, or pneumatically. The control slide 34 can be adjusted via a suitable adjusting unit (not shown). Otherwise, the position of the control slide 34 inside the valve mechanism remains fixed, even if forces are exerted on it from outside. The adjusting unit can each be actuatable electrically, hydraulically, or pneumatically.

As soon as the stop disk 26 strikes the control slide 34, the sealing slide 10 can no longer execute any motion in the opening direction of the gas exchange valve 12. Since the gas exchange valve 12 is moved onward by the camshaft, the sealing seat 28 of the gas exchange valve 12 lifts away from the sealing seat 30 of the sealing slide 10, and air can penetrate the combustion chamber. In the process, the coupling spring 24 is compressed.

If the gas exchange valve 12 follows the closing flank of the camshaft, it is pressed in the closing direction by the valve spring 16. The sealing seat 28 of the gas exchange valve 12 presses against the sealing seat 30 of the sealing slide 10. The sealing slide 10 is carried along, until the sealing seat 28 of the gas exchange valve 12 rests on the valve seat ring 22, and the gas exchange valve 12 is closed.

The gas exchange valve 12 and thus also the sealing slide 10 follow the cam course of the camshaft. At a certain instant, the stop disk 26, which is connected to the sealing slide 10, strikes the control slide 34 (in the state shown in FIG. 1). After that, the sealing slide 10 can no longer follow the cam course of the camshaft. The gas exchange valve 12 lifts from the sealing slide 10, and air can get into the combustion chamber.

By axial displacement of the position of the control slide 34 via an adjusting unit (not shown), it can be established when the sealing seat 28 of the gas exchange valve 12 will lift from the sealing seat 30 of the sealing slide 10. In this advantageous way, the opening cross section of the gas exchange valve 12 and thus also the quantity of air reaching the combustion chamber can be regulated.

The foregoing relates to preferred exemplary embodiments of the invention, it being understood that other variants and embodiments thereof are possible within the spirit and scope of the invention, the latter being defined by the appended claims.

What is claimed is:

1. In a valve mechanism with a variable valve opening cross section, in which the valve mechanism is disposed at an admission opening of an internal combustion engine and has a gas exchange valve, which is acted on by the force of a valve spring and is displaceable axially back and forth inside a guide by a valve control unit, the improvement comprising a sealing slide (10) disposed coaxially to the gas exchange valve (12), wherein the variable opening is created between the gas exchange valve (12) and the sealing slide, the sealing slide (10) being displaceable axially back and forth by the valve control unit, including a coupling spring (24) acting on and applying force to the sealing slide (10), the valve mechanism including means which, when the sealing slide is being axially displaced by the control unit, can stop the motion of the sealing slide at a selected position, so that, as the gas exchange valve (12) continues to travel after the sealing slide is stopped, the variable valve opening between the gas exchange valve (12) and the sealing slide (10) is created.

2. The valve mechanism of claim 1, wherein the valve control unit includes a camshaft.

3. The valve mechanism of claim 1, wherein the gas exchange valve (12) has a rotationally symmetrical basic construction and comprises a valve shaft (14), on whose lower end a valve plate (20) is disposed.

4. The valve mechanism of claim 3, wherein the valve plate (20) comprises a conical circumferential face, which forms a sealing seat (28) of the gas exchange valve (12).

5. The valve mechanism of claim 4, wherein in a closing position of the valve mechanism, the sealing seat (28) of the gas exchange valve (12) directly contacts both a sealing seat (30) of the sealing slide (10) and a valve seat ring (22) of the cylinder head (18).

6. The valve mechanism of claim 1, wherein the sealing slide (10) comprises a bushlike bearing body (40) disposed displaceably axially back and forth inside a guide of the cylinder head (18).

7. The valve mechanism of claim 6, wherein the bushlike bearing body (40) of the sealing slide (10) forms the guide of the gas exchange valve (12), inside which the gas exchange valve (12) is displaceable axially back and forth.

8. The valve mechanism of claim 1, wherein the sealing slide (10) comprises a cylindrical sealing body (38), and on its lower end, the outer face of the sealing body (38) forming a sealing seat (30).

9. The valve mechanism of one of claim 8, wherein the sealing slide (10) includes a bearing body (40), and the sealing body (38) is connected to the bearing body (40) via connecting rods(42).

10. The valve mechanism of claim 6, the means for stopping the sealing slide (10) includes a stop disk (26) secured to the bearing body (40) of the sealing slide near its upper end.

11. The valve mechanism of claim 7, the means for stopping the sealing slide (10) includes a stop disk (26) secured to the bearing body (40) of the sealing slide near its upper end.

12. The valve mechanism of claim 8, the means for stopping the sealing slide (10) includes a stop disk (26) secured to the bearing body(40) of the sealing slide near its upper end.

13. The valve mechanism of claim 9, the means for stopping the sealing slide (10) includes a stop disk (26) secured to the bearing body (40) of the sealing slide near its upper end.

14. The valve mechanism of claim 10, wherein the stop disk (26) comprises two parts.

15. The valve mechanism of claim 14, wherein the two parts of the stop disk (26) are surrounded by a clamping ring (36).

16. In a valve mechanism with a variable valve opening cross section, in which the valve mechanism is disposed at an admission opening of an internal combustion engine and has a gas exchange valve, which is acted on by the force of a valve spring and is displaceable axially back and forth inside a guide by a valve control unit, the improvement comprising a sealing slide (10) disposed coaxially to the gas exchange valve (12), the sealing slide (10) being displaceable axially back and forth by the valve control unit, and a coupling spring (24) acting on and applying force to the sealing slide (10), the control unit being operable to jointly trigger movement of the gas exchange valve (12) and the sealing slide (10), wherein during a first portion of movement of the gas exchange valve (12) the sealing slide (10) moves with the gas exchange valve (12) so that the gas exchange valve remains closed, and then movement of the sealing slide (10) is stopped during a second portion of movement of the gas exchange valve (12) so that during the second portion of movement of the gas exchange valve (12) the gas exchange valve (12) is opened.

17. The valve mechanism of claim 16, further including a stop disk (26) mounted on the sealing slide (10), and a control slide (34) which is positioned so as to be engaged by the stop disk (26) as the sealing slide (10) moves with the gas exchange valve (12), the control slide (34) thus stopping movement of the sealing slide (10) while the gas exchange valve (12) continues to move.

18. The valve mechanism of claim 17, wherein the control slide (34) is selectively positionable so as to determine at what point sealing slide (10) stops moving and thus at what point the gas exchange valve (12) will open.

19. The valve mechanism of claim 18, further including means to selectively control the position of the control slide (34).

* * * * *